US009487948B1

(12) United States Patent
Bakker et al.

(10) Patent No.: US 9,487,948 B1
(45) Date of Patent: Nov. 8, 2016

(54) PARTITION SYSTEM

(71) Applicant: Scranton Products, Inc., Scranton, PA (US)

(72) Inventors: Mitchell Ray Bakker, Holland, MI (US); Christopher Michael George, Moscow, PA (US)

(73) Assignee: Scranton Products, Inc., Scranton, PA (US)

( * ) Notice: Subject to any disclaimer, the term of this patent is extended or adjusted under 35 U.S.C. 154(b) by 0 days.

(21) Appl. No.: 14/852,702

(22) Filed: Sep. 14, 2015

(51) Int. Cl.

| | |
|---|---|
| ***E04B 2/82*** | (2006.01) |
| ***E04H 1/00*** | (2006.01) |
| ***E04B 2/74*** | (2006.01) |
| ***E04H 1/12*** | (2006.01) |
| ***E06B 5/00*** | (2006.01) |

(52) U.S. Cl.
CPC ..... *E04B 2/7401* (2013.01); *E04B 2/7405* (2013.01); *E04H 1/125* (2013.01); *E04H 1/1266* (2013.01); *E06B 5/00* (2013.01); *E04B 2002/7461* (2013.01)

(58) Field of Classification Search
CPC . E04B 2/7401; E04B 2/7405; E04H 1/1266; E04H 1/125; E06B 5/00; E06B 2002/7461; A47K 2003/30; A47K 3/36; Y10T 16/547; Y10T 16/5474; Y10T 16/5475; Y10T 16/5476; E05D 3/00; E05D 3/06; E05D 3/12; E05D 3/125; E05D 3/127; E05D 3/145; E05D 3/183; E05D 3/186; E05D 15/10; E05D 15/1005; E05D 15/1013; E05D 15/1015
USPC ..... 52/243; 4/600, 607; 160/210–213
See application file for complete search history.

(56) References Cited

U.S. PATENT DOCUMENTS

| | | | | |
|---|---|---|---|---|
| 2,794,208 | A * | 6/1957 | Scroggins | E05D 1/04 16/267 |
| 2,938,247 | A * | 5/1960 | Hagerty | E06B 3/40 49/390 |
| 3,370,388 | A * | 2/1968 | Dielman | A47K 3/284 49/501 |
| 5,592,787 | A | 1/1997 | Ophardt | |
| 5,630,302 | A | 5/1997 | Rosenband | |
| 7,168,477 | B2 * | 1/2007 | Salice | E05D 15/262 160/213 |
| D613,882 | S | 4/2010 | Thielke et al. | |

(Continued)

OTHER PUBLICATIONS

Scranton Products New Hardware-Two New Designer Looks add Strength and Longevity; http://www.scholarplastics.ca/content/news/scranton-products-introduces-new-hardware-with-two-new-designer-looks-that-add-strength-and-longevity [Aug. 25, 2015].

*Primary Examiner* — Joshua J Michener
*Assistant Examiner* — Keith Minter
(74) *Attorney, Agent, or Firm* — Buchanan Ingersoll & Rooney PC

(57) ABSTRACT

In a partition system partitions there are two or more doors, positioned side by side in a common plane. Adjacent doors have angled sides that meet when the doors are closed. Each door is attached to a post or partition by a pair of hinges and is mounted so that there is a space between each pair of adjacent doors. Any sight line through each space between adjacent doors when the front surfaces of those doors are parallel to the common plane will intersect one of the posts or one of the partitions. The hinges may provide an axis of rotation that is inward from the edge of the door. The partitions are preferably mounted on frame members that have an L-shaped or inverted T-shaped cross-section. The partitions have a slot along one side which receives the upright portion of the frame members.

17 Claims, 8 Drawing Sheets

(56) References Cited

U.S. PATENT DOCUMENTS

| | | | | |
|---|---|---|---|---|
| 7,707,687 | B2 * | 5/2010 | Giovannetti | E05D 3/14 16/289 |
| D623,769 | S | 9/2010 | Thielke et al. | |
| 7,987,635 | B2 | 8/2011 | Thielke et al. | |
| D664,268 | S | 7/2012 | Thielke et al. | |
| 8,726,578 | B2 | 5/2014 | Thielke et al. | |
| 2006/0101736 | A1 * | 5/2006 | Okugawa | E06B 1/52 52/204.1 |
| 2011/0265385 | A1 | 11/2011 | Thielke et al. | |
| 2014/0283469 | A1 * | 9/2014 | Babikian | E06B 7/21 52/205 |
| 2015/0113724 | A1 * | 4/2015 | Corpuz, Jr. | A47K 3/36 4/607 |

* cited by examiner

PARTITION SYSTEM

FIELD OF INVENTION

The present invention relates generally to partitions that define restroom stalls to provide privacy for persons using the restroom.

BACKGROUND

Various types of establishments, such as office buildings, educational facilities, recreational facilities, restaurants and shopping centers provide areas such as restrooms, showers, and changing rooms where users normally require or desire some level of privacy. In order to provide such privacy, partitions or partition systems may be used to provide areas or stalls (e.g., a bathroom stall, a shower stall, or a changing room) for private, individual use. A partition system typically includes panels and doors installed on a frame that define one or more stalls or changing rooms. In conventional partition systems a pilaster is provided on either side of each door. Pilasters are rectangular structures that may be several inches wide that extend from the floor.

The art has been concerned with creating partition systems in which there are no sight lines between the partitions, pilasters and doors that would enable one who is outside of the stall to see into the stall when the door is closed. U.S. Pat. Nos. 7,987,635 B2, 8,726,578 D613,882 S, D632,769 S and D664,268 S disclose partition systems in which there is a projection on the door that extends into a recess on the adjacent pilaster to define a seam that prevents a line of sight from being established through the seam when the door is in the closed position. Alternatively, the projection may be on the pilaster and the recess may be in the edge of the door. One shortcoming of the system disclosed in these patents, as well as other partition systems that have pilasters, is that the pilasters are obstructions to mopping the floor making some areas near and the pilaster more difficult to reach and clean.

In conventional partition systems the edges of the partitions or panels fit within U-shaped or H-shaped frames. In the case of stainless steel partitions the hardware finish matches that of the partitions in an effort to make the hardware less noticeable. In other partition systems in which the frames are a different color and may be made from a different material, the partitions and frames are painted the same color to make the hardware less noticeable. Yet in both systems the hardware is visible. U.S. Pat. No. 5,630,302 discloses an example of this type of metal framing system. That patent shows a partition system in which the panels slide into a U-shaped metal frame and the metal is clearly visible on the outside and inside of the partition system. Architects and designers have expressed a need for a more modern looking, less industrial looking, cleaner aesthetic—the industrial look coming from bulky, visible hardware throughout the system.

Partition systems, particularly those used in bathrooms and shower rooms, are often installed in a room in which the floor is not level and slopes toward a drain. It is important that the doors and partitions as well as the head rail above the doors and partitions be level. In conventional systems the pilasters and posts are placed in shoes that are attached to the floor and enable the pilaster or post to be adjusted up and down. However, such movement may cause misalignment between adjacent doors and cause the head rail to be titled. Such misalignment may be a problem for installers if the pilasters and posts have predrilled holes for attachment of the doors and frame elements.

There is a need for a partition system in which the doors and partitions are supported on spaced apart posts and there are no pilasters. Such a system will have a small footprint making the floor beneath the partition system easier to clean. This partition system should have no sight lines between the partitions and doors that would enable one who is outside of the stall to see a person who is in the stall when the door is closed.

There is also a need for a partition system that can be installed in a room having a sloping or uneven floor and in which the doors, partitions and head rail can be easily leveled.

SUMMARY OF THE INVENTION

We provide a partition system having one or more posts and one or more doors depending upon the number of enclosed spaces that are created and whether the system is in the corner of a room. Unless the installation is a single enclosed space and the walls of a building define all walls of that space except where the door is located, the system will contain one or more partitions. Each partition is attached to a respective one of the posts. In those systems that define two or more enclosed spaces there are two or more doors, positioned side by side in a common plane. Each door has a front surface, a back surface, a left side having a left side surface, a right side having a right side surface, a top and a bottom. The sides do not meet the front surface and the back surface at right angles. If the door opens in a first direction the left side surface and the front surface meet at a selected obtuse angle, the left side surface and the back surface meet at a selected acute angle, the right side surface and the front surface meet at the selected acute angle and the right side surface and the back surface meet at the selected obtuse angle. If the door opens in the opposite direction then left side surface and the front surface meet at a selected acute angle, the left side surface and the back surface meet at a selected obtuse angle, the right side surface and the front surface meet at the selected obtuse angle and the right side surface and the back surface meet at the selected acute angle. The acute angle should be between 30° and 60°.

Each door is attached to a post or partition by a pair of hinges and is mounted so that there is a space between each pair of adjacent doors. Any sight line through each space between adjacent doors when the front surfaces of those doors are parallel to the common plane will intersect one of the posts or one of the partitions. Consequently, someone who is outside of the stall defined by the partition system cannot see a person who is in the enclosed space when the door is closed.

We further prefer to provide a pair of hinges that are configured and mounted to the door to provide a turning axis about which the door turns when being opened and closed. This turning axis is spaced from the left side of the door or the right side of the door by a distance of 5 or more inches, preferably 6 to 8 inches from the side nearest the hinge. A door which opens inward and uses this hinge arrangement will not extend into the stall as far as a door of the same size would extend into that stall if that door had been mounted using a conventional hinge. The offset axis of rotation provided by these hinges permits the use of a wider door than a conventional door by providing sufficient clearance so that the wider door when opened will not hit the toilet in the stall.

We further prefer to provide hinges that are configured and mounted to the door to enable the door to be moved in a vertical direction and moved in a horizontal direction. This enables the door to be leveled and aligned with adjacent doors.

We also prefer to provide a head rail that is connected with adjustment blocks to the top of each of the posts. These blocks enable the head rail to be moved toward and away from the posts. This is a particularly important feature in an installation which is on a sloping floor and all of the posts are the same standard length.

We also prefer to provide framing elements that have a base and an upright extending from the base. The framing elements are attached to a wall. The partitions have a right side surface or a left side surface which has a slot which receives the upright. The framing elements may have a T-shaped cross-section or an L-shaped cross-section. These framing elements are less visible than the traditional U-shaped frames that are in use today and they provide a much cleaner aesthetic. The ordinary observer may not even notice these framing elements.

Yet another advantage of the present partition system is that it does not have any traditional pilasters. The absence of traditional pilasters provides a clean, horizontal alignment at the front of the system as each door is adjacent to the next door with no visual break between them.

Other objects and advantages of our partition system will become apparent from a description of certain present preferred embodiments thereof which are shown in the drawings.

DESCRIPTION OF THE PREFERRED EMBODIMENTS

Figure 1:
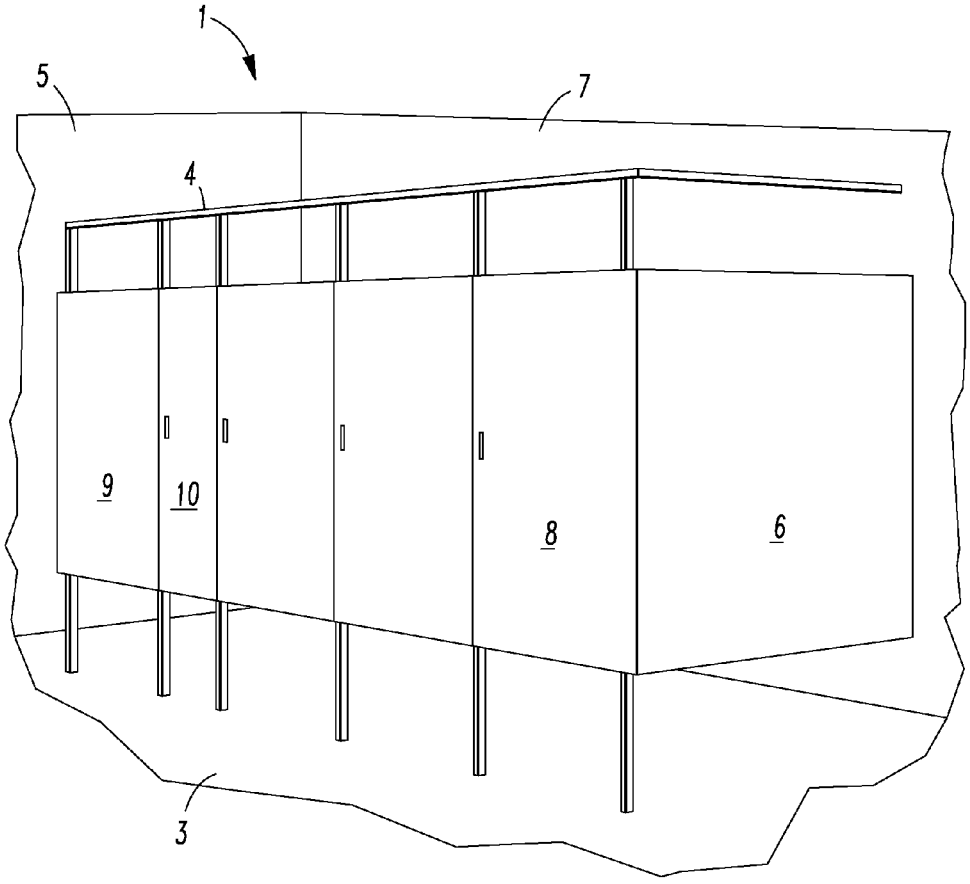
FIG. 1 is a perspective view of a present preferred embodiment of our partition system in a corner configuration.
Figure 2:
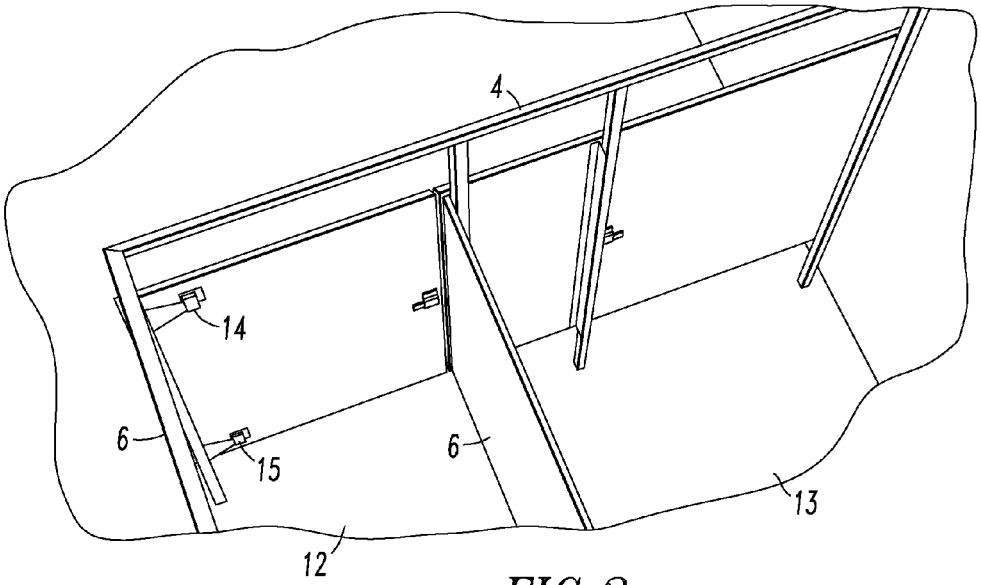
FIG. 2 is a perspective view of a second present preferred embodiment of our partition system having two stalls.

Referring to FIGS. 1 and 2, our partition system 1 in a corner configuration has a series of spaced apart posts 2. The bottom of each post is attached to the floor 3. A head rail 4 sits on the top of each post 2. One end of the head rail 4 is attached to wall 5 and the opposite end of the head rail 4 is attached to wall 7. A partition 6 extends from each post 2 to wall 7 to define a series of stalls. The embodiment shown in FIG. 1 has three standard size stalls and one handicap stall while the embodiment shown in FIG. 2 has one standard size stall 12 and one handicap stall 13. Doors 8 are provided for the standard size stalls and a handicap door 9 is provided for the handicap stall. The doors 8, 9 may all be the same size. A panel 10 is provided adjacent the handicap door 9 so that the handicap stall is larger than the standard size stalls. All of the doors 8, 9 are in a common plane when the doors are in a closed position.

As can be seen most clearly in FIG. 2, each door is attached to a respective one of the posts by a pair of hinges such that there is an upper hinge 14 and a lower hinge 15. We prefer to use the hinge shown in FIGS. 7 and 8 on the standard stall doors 8 and the hinge shown in FIGS. 9, 10 and 11 on the door 9 for the handicap stall.

Figure 3:
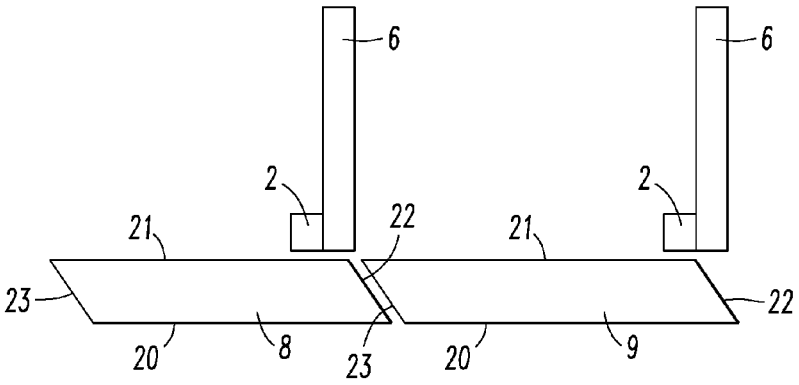
FIG. 3 is a top view of two adjacent doors in a third present preferred embodiment in a closed position.
Figure 4:
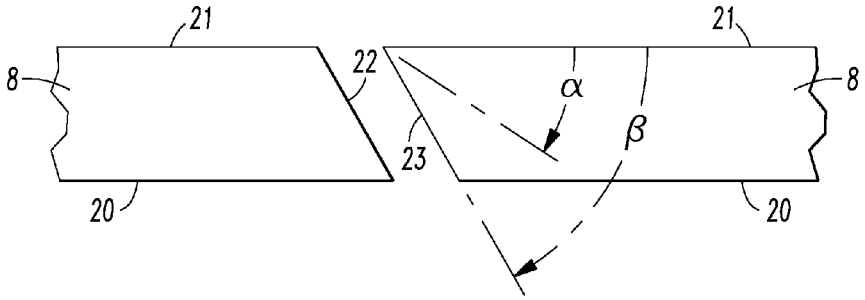
FIG. 4 is a fragmentary view of the doors in FIG. 3 showing the range of acceptable angles of the sides relative to the front surface and the rear surface of the doors.

The doors 8, 9 have a front surface 20, a back surface 21, a left side having a left side surface 22, a right side having a right side surface 23. Preferably, the side surfaces 22, 23 of the doors are flat and the edges are beveled or have a radius. The left side surface 22 and the front surface 20 meet at a selected acute angle and the left side surface 22 and the back surface 21 meet at a selected obtuse angle. Similarly the right side surface 23 and the front surface 20 meet at the selected obtuse angle and the right side surface 23 and the back surface 21 meet at the selected acute angle. If the door opens in the opposite direction then left side surface and the front surface meet at a selected obtuse angle, the left side surface and the back surface meet at a selected acute angle, the right side surface and the front surface meet at the selected acute angle and the right side surface and the back surface meet at the selected obtuse angle. As shown in FIG. 4, the selected acute angle should be between 30°, angle $\alpha$, to 60°, angle $\beta$, and preferably is 60°. There is a space, seen most clearly in FIG. 3, between each pair of adjacent doors when the doors are closed and any sight line through that space intersects one of the spaced apart posts 2 or one of the partitions 6. Consequently, someone who is outside of the stall defined by the partition system cannot see a person who is in the stall when the door is closed.

Figure 5:
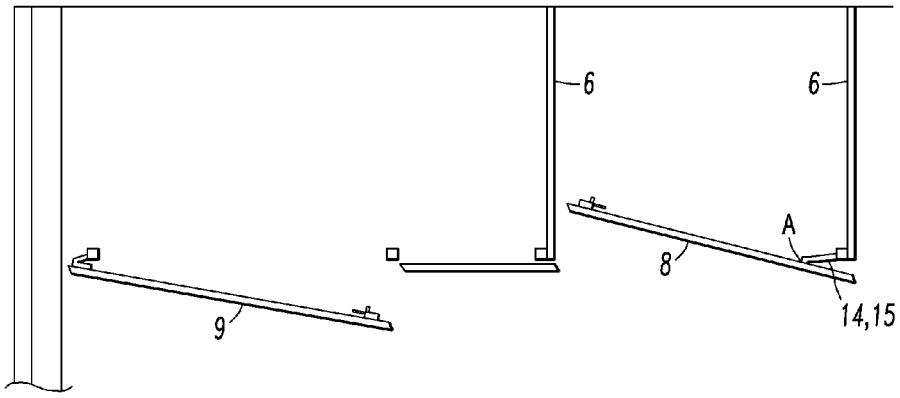
FIG. 5 is a top view of a portion of the embodiment of FIG. 2 showing the doors in a partially open position.
Figure 6:
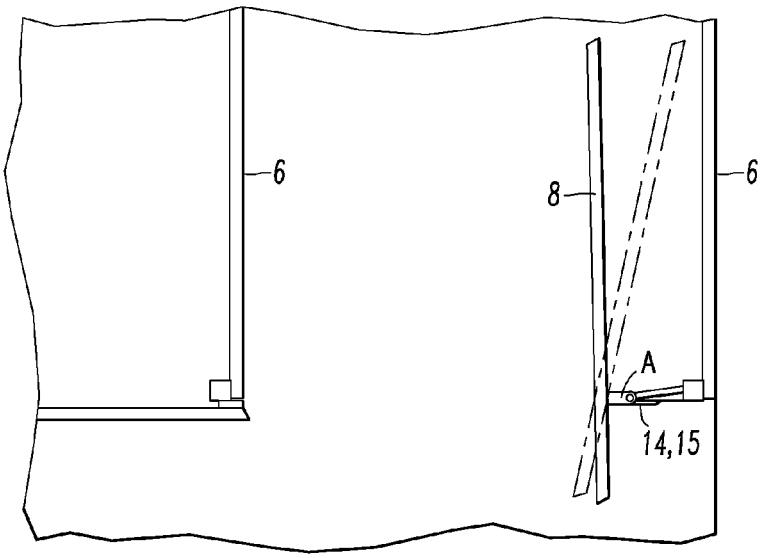
FIG. 6 is a top view of a portion of the embodiment of FIG. 2 showing one of the doors in a fully open position.

Referring to FIGS. 2, 5 and 6 we prefer that the upper hinge 14 and the lower hinge 15 on the doors 8 for the standard size stalls be configured to have an axis of rotation A that is offset from the side of the door. That axis of rotation A is indicated by the broken line in FIG. 7 and points in FIGS. 5 and 6. As the door 8 is opened inward the door will extend into the stall 12 a shorter distance than would occur if the door had been attached by a standard hinge. We prefer that the axis of rotation be offset by more than five inches and preferably 6 to 8 inches from the side of the door nearest the hinge. If the stall is 36 inches wide and the door 8 is the same width the opening between the fully opened doors will be about 27.5 inches when the axis of rotation is 8 inches from the side of the door.

Figure 7:
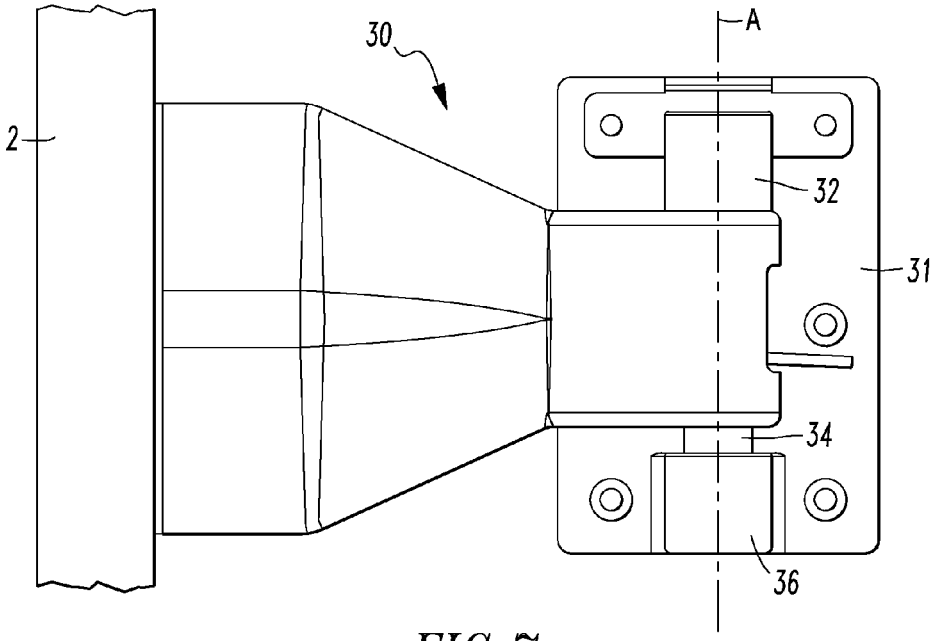
FIG. 7 is a front view of a present preferred embodiment of a hinge that can be used in our partition system, the hinge being attached to a post in our partition system.
Figure 8:
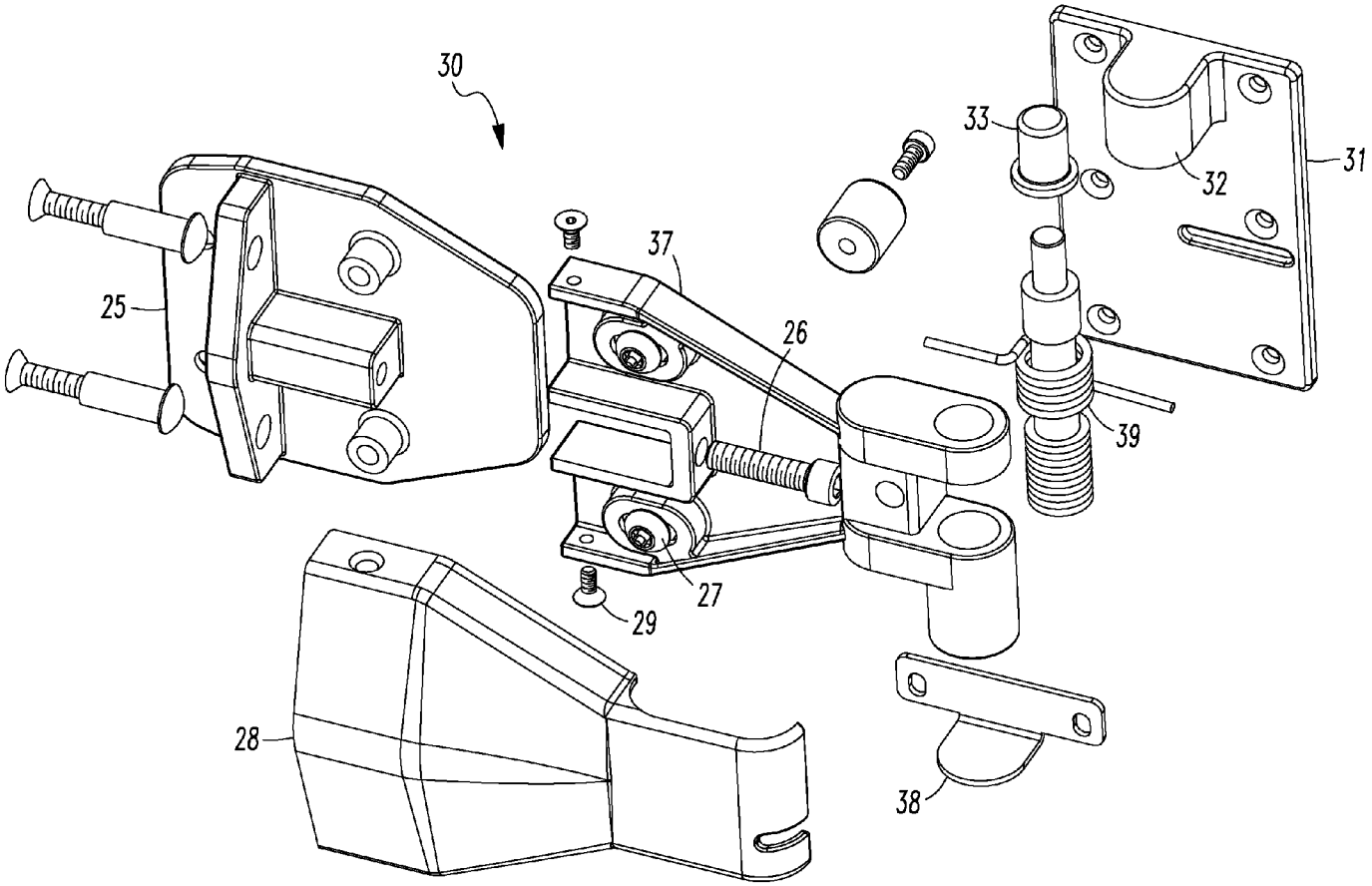
FIG. 8 is an exploded view of the hinge shown in FIG. 7.

The hinge 30 shown in FIGS. 7 and 8 is configured to provide an offset axis of rotation indicated by broken line A in FIG. 7. This hinge has a plate 31 that is attached to the door. The plate has a boss 32 that receives a bushing 33 on the end of the shaft or axle 34 of pivot pin 35. The head 36 of the pivot pin 35 is threaded and fits into arm 37. The pivot pin rests on seat 38 such that the hinge can be adjusted up or down according to the amount that the threaded head 36 extends into the arm 37. Spring 39 on the pivot pin provides self-closing for the door. Mounting plate 25 is attached to the post 2 and to arm 37. Screw 26 along with the screw and slot arrangements 27 enabled the arm 37 to be adjusted horizontally relative to the mounting plate 25 and the post to which the mounting plate is attached. Cover 28 fits over arm 37 and is held in place by screws 29.

Figure 9:
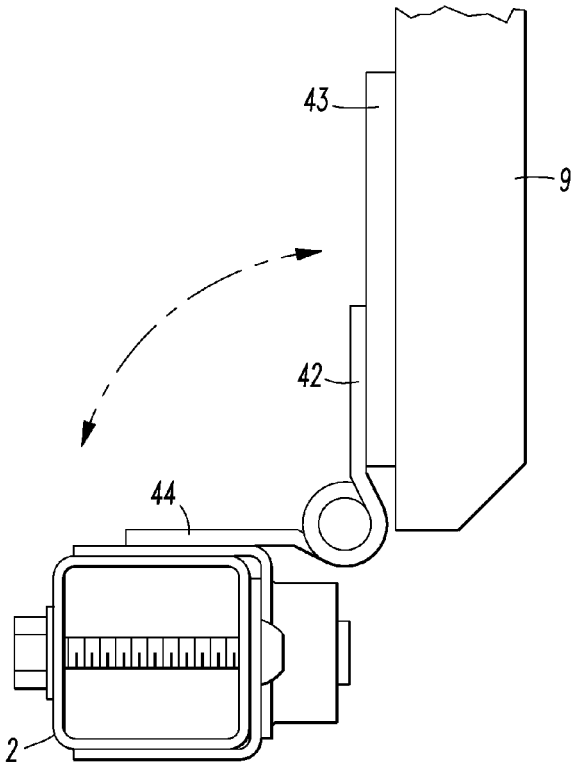
FIG. 9 is a top view of a second present preferred embodiment of a hinge that can be used in our partition system when the hinge is attached to a door in an open position.
Figure 10:
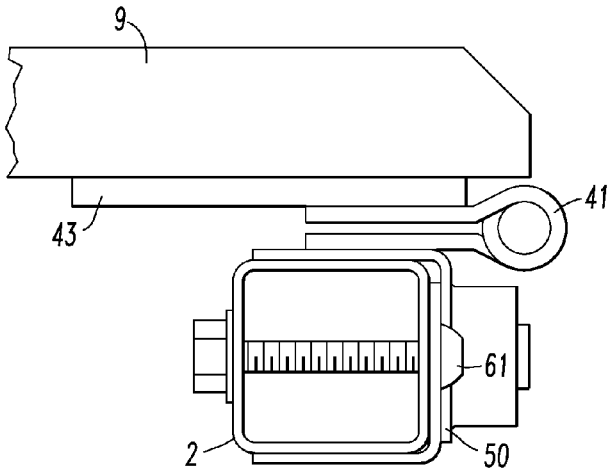
FIG. 10 is a top view of the hinge shown in FIG. 9 when the hinge is attached to a door in a closed position.
Figure 11:
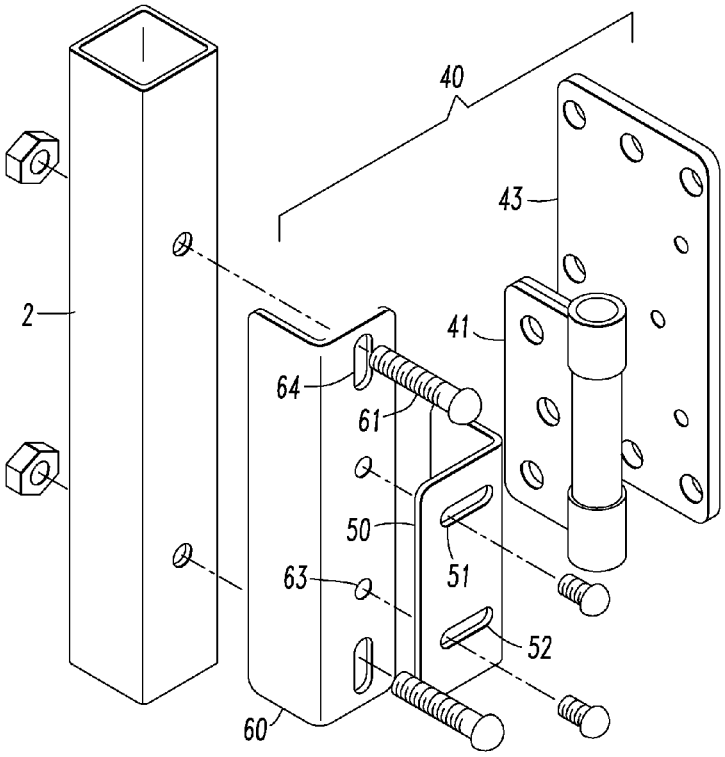
FIG. 11 is an exploded view of the hinge shown in FIGS. 9 and 10.

A second present preferred hinge 40, shown in FIGS. 9, 10 and 11, is provided to attach the door 9 for the handicap stall to a post or partition. This hinge has a conventional self-closing hinge 41 having a first leaf 42 that attaches to a mounting plate 43 which is attached to a door 9. The second leaf 44 is attached to angle bracket 50 which has a pair of slots 51, 52. Angle bracket 50 is attached to mounting bracket 60 by screws 54 that pass through the slots into mounting bracket 60. This connection enables angle bracket 50 to be moved toward or away from post 2 to which bracket 60 is attached providing an inward or outward adjustment for the door. Bracket 60 is attached to a post 2 by bolts 61. The bolts pass through the vertical slots 64 in the bracket 60. These slots enable the bracket 60 to be adjusted in a vertical direction such that the door attached to the hinge can be moved up or down. Angle bracket 50 with slots 51, 52 and bracket 60 with slots 64 provide both vertical adjustment and horizontal adjustment to the door to which this hinge 40 is attached. We prefer to provide a horizontal adjustment of plus or minus ¾ inches in an in or out direction and to provide a vertical adjustment of plus or minus ¼ inches up and down. We prefer to make the mounting plate 43, mounting bracket 60 and the angle bracket 50 of aluminum or stainless steel.

Figure 12:
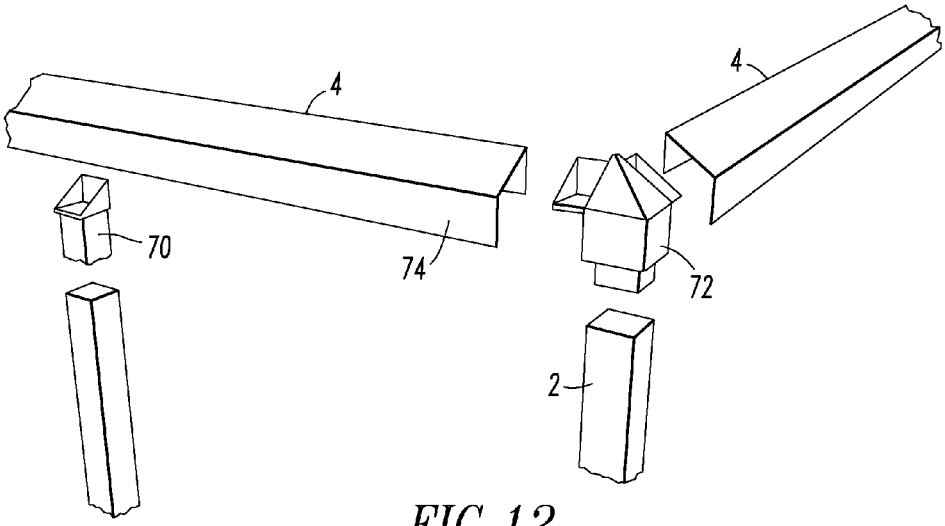
FIG. 12 is an exploded view of the head rail, the top of two of the posts and two present preferred adjustment blocks that can be used in our partition system.

We also prefer to provide a head rail 4 which is an inverted U-shaped channel as shown in FIG. 12. One or more adjustment blocks 70 and corner blocks 72 are provided to enable the top rails to be raised at selected posts 2 when the posts 2 are installed on an uneven or sloping floor. Blocks 70 and 72 fit within the top rail 4 and also fit within the post 2. By sliding the block 70, 72 into and out of the post, an installer can adjust the head rail to be level. Screws (not shown) are provided to attach each adjustment block 70 and each corner block 76 to the head rail 4 and the post 2. We prefer to provide for a total adjustment of 1.5 inches. The front 74 of the head rail 4 extends downward and overlaps these blocks 70, 72 and a portion of the posts 2 to which the head rail is attached. If the front of the head rail is shorter than the maximum adjustment then a portion of the blocks 70, 72 will be exposed if the amount of the adjustment is greater than the length of the front of the head rail. Because we provide adjustment blocks for attaching the head rail to the posts it is not necessary to provide adjustable feet on the bottom ends of the posts.

Figure 13:
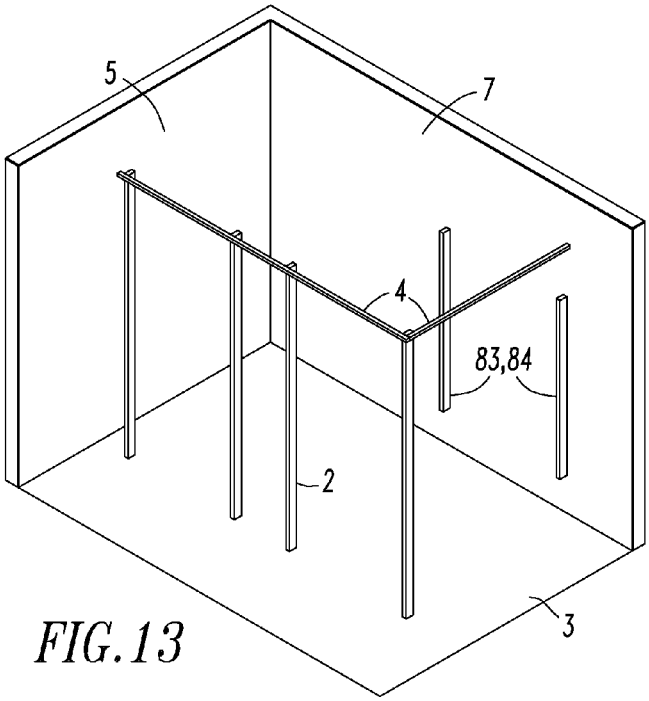
FIG. 13 is a perspective view of the framing for our partition system for two bathroom stalls.
Figure 14:
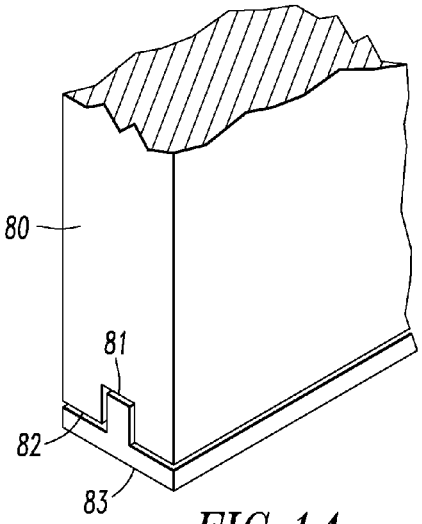
FIG. 14 is a fragmentary view of a partition on an inverted T-shaped frame member.
Figure 15:
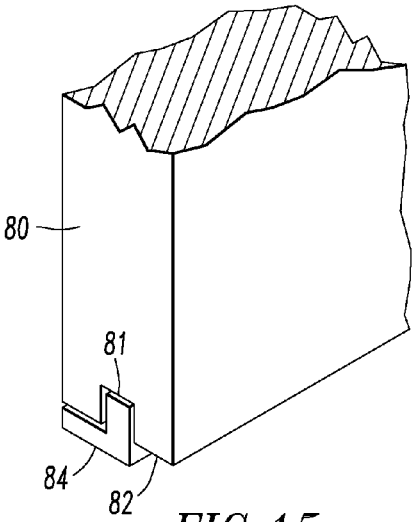
FIG. 15 is a fragmentary view of a partition on an L-shaped frame member.

When our partition system is installed, the installer erects the frame which contains the posts 2, head rail 4 and frame members 83, 84. An example of the frame for an installation having two stalls is shown in FIG. 13. We prefer to provide partitions 80 having a slot 81 along the side 82 that is attached to a frame member 83 or 84. The frame member 83 may have an inverted T-shaped cross section as shown in FIG. 14 or the frame member 84 may have an L-shaped cross section as shown in FIG. 15. The slot in the partition is sized to receive the upright portion of the frame. Screws (not shown) are used to attach the partition to the frame member. The screws are inserted through a surface of the partition that faces the interior of the stall or other enclosed space. When the partition system is fully installed the frame members 83, 84 that supports the partitions will not be noticeable by the casual observer.

The partitions shown in the drawings are spaced apart from both the floor and the ceiling. However, the partitions could be any desired height and extend from floor to ceiling. Furthermore, one or more of the partitions could be a wall.

We prefer to make the partitions of high density polyethylene and to use aluminum frame members. High density polyethylene is durable, can be scratch resistant and is available in a variety of colors. However, other suitable materials could be used for these components.

The partition system here disclosed is easy to install and easy to level. When the system is fully assembled the structure has a clean sleek appearance and provides complete privacy.

In the drawings we have shown our partition system located in the corner of a room and having two or more stalls. However, the partition system is not limited to that configuration. The system can be free standing and can define any selected number of enclosed spaces or stalls. In an enclosure in which walls define an enclosed space large enough to receive a person and an opening for a door, our door and a single post can be used in that opening.

Although we have shown and described certain present preferred embodiments of our partition system it is to be distinctly understood that our invention is not limited thereto and may be variously embodied within the scope of the following claims.

We claim:

1. A partition system comprising:

a plurality of spaced apart posts;

a plurality of spaced apart partitions which are substantially parallel to one another, each partition attached to a respective one of the posts;

a plurality of doors, positioned side by side in a common plane, each door having top, a bottom, a front surface, a back surface, a first side having a first side surface, and a second side having a second side surface, the second side being opposite the first side;

wherein the first side surface and the front surface meet at selected obtuse angle, the first side surface and the back surface meet at a selected acute angle, the second side surface and the front surface meet at the selected acute angle and the second side surface and the back surface meet at the selected obtuse angle;

a set of hinges, each set comprised of an upper hinge and a lower hinge, one set of hinges attached to each of the plurality of doors and to a selected one of the plurality of partitions or a selected one of the plurality of spaced apart posts thereby mounting the door;

wherein each door is mounted so that there is a space between each pair of adjacent doors and any sight line through each space between adjacent doors when the front surfaces of those doors are parallel to the common plane will intersect at least one of the spaced apart posts and the spaced apart partitions; and wherein the hinges each have a hinge plate attached to one of the doors and a mounting plate attached to one of the posts or the partitions and the hinges are configured to provide a turning axis adjacent the hinge plate and about which the door turns when being opened and closed, the turning axis being spaced from the first side of the door or from the second side of the door by a distance greater than five inches.

2. The partition system of claim 1 wherein the selected acute angle is from 30° to 60°.

3. The partition system of claim 1 wherein at least one of the first side surface of each of the plurality of doors and the second side surface of each of the plurality of doors is flat.

4. The partition system of claim 1 wherein the turning axis is between six inches and eight inches from the first side of the door or from the second side of the door.

5. The partition system of claim 1 wherein the hinges in at least one set of hinges are configured and mounted to the door to enable the door to be moved in a vertical direction and to be moved in a horizontal direction.

6. The partition system of claim 1 also comprising a panel connected to at least one of the plurality of spaced apart posts, the panel having:

a front surface, a back surface, a first side having a first side surface, a second side having a second side surface, the second side being opposite the first side, wherein the first side meets the front surface at an angle which is not a right angle and the first side meets the back surface at an angle which is not a right angle;

wherein the first side surface of the panel is opposite the first side surface of one of the doors; and wherein the panel is mounted so that there is a space between the first side surface of the panel and the first side surface of one of the doors and any sight line through that space when the front surface of the panel and the front surface of the door are parallel to the common plane will intersect at least one of the spaced apart posts and the spaced apart partitions.

7. The partition system of claim 1 wherein each of the spaced apart posts have a top and further comprising a head rail attached to the tops of the spaced apart posts.

8. The partition system of claim 7 also comprising a plurality of adjustment blocks each adjustment block attached to a respective one of the spaced apart posts and to the head rail in a manner so that the head rail can be moved toward and away from at least one of the spaced apart posts.

9. A partition system comprising:

a plurality of spaced apart posts;

a plurality of spaced apart partitions which are substantially parallel to one another, each partition attached to a respective one of the posts;

a plurality of doors, positioned side by side in a common plane, each door having top, a bottom, a front surface, a back surface, a first side having a first side surface, and a second side having a second side surface, the second side being opposite the first side;

wherein the first side surface and the front surface meet at selected obtuse angle, the first side surface and the back surface meet at a selected acute angle, the second side surface and the front surface meet at the selected acute angle and the second side surface and the back surface meet at the selected obtuse angle;

a set of hinges, each set comprised of an upper hinge and a lower hinge, one set of hinges attached to each of the plurality of doors and to a selected one of the plurality of partitions or a selected one of the plurality of spaced apart posts thereby mounting the door;

wherein each door is mounted so that there is a space between each pair of adjacent doors and any sight line through each space between adjacent doors when the front surfaces of those doors are parallel to the common plane will intersect at least one of the spaced apart posts and the spaced apart partitions; and wherein each of the partitions has a side surface having a slot and further comprising a plurality of framing elements each framing element having a base and an upright extending from the base, the upright being within the slot of a respective one of the plurality of partitions.

10. The partition system of claim 9 wherein the framing elements have a T-shaped cross-section or an L-shaped cross-section.

11. The partition system of claim 1 wherein the doors and the partitions are high density polyethylene.

12. The partition system of claim 1 wherein at least one of the plurality of partitions is a wall.

13. An enclosure comprising walls which define an enclosed space large enough to receive a person and an opening for a door and further comprising:

a post positioned within or adjacent the opening and a door attached to one of the walls or the post, the door having top, a bottom, a front surface, a back surface, a first side having a first side surface, and a second side having a second side surface, the second side being opposite the first side;

wherein the first side surface and the front surface meet at selected angle which is not a right angle and the first side surface and the back surface meet at a selected angle which is not a right angle;

a set of hinges comprised of an upper hinge and a lower hinge, the hinges attached to the door and attached to the post or one of the walls in a manner so that there is a sight line adjacent the first side surface of the door when the door is in a closed position and that sight line intersects the post or one of the walls; and wherein the hinges each have a hinge plate attached to one of the doors and a mounting plate attached to one of the posts or walls and the hinges are configured to provide a turning axis adjacent the hinge plate and about which the door turns when being opened and closed, the turning axis being spaced from the first side of the door or from the second side of the door by a distance greater than five inches.

14. The enclosure of claim 13 wherein the first side surface meets the back surface or meets the front surface at a selected angle of from 30° to 60°.

15. The enclosure of claim 13 wherein the first side surface is flat.

16. The enclosure of claim 13 wherein the turning axis is between six inches and eight inches from the first side of the door or from the second side of the door.

17. The enclosure of claim 13 wherein the hinges in at least one set of hinges are configured and mounted to the door to enable the door to be moved in a vertical direction and to be moved in a horizontal direction.

* * * * *